US009441591B2

(12) United States Patent
Ramamurthy et al.

(10) Patent No.: US 9,441,591 B2
(45) Date of Patent: Sep. 13, 2016

(54) INTEGRATED SEALING AND POSITIONING STRUCTURE FOR FUEL RAIL

(71) Applicant: DENSO International America, Inc., Southfield, MI (US)

(72) Inventors: Dhyana Ramamurthy, Novi, MI (US); Steven Roseborsky, Kingsville (CA)

(73) Assignee: Denso International America, Inc., Southfield, MI (US)

( * ) Notice: Subject to any disclaimer, the term of this patent is extended or adjusted under 35 U.S.C. 154(b) by 266 days.

(21) Appl. No.: 13/839,767

(22) Filed: Mar. 15, 2013

(65) Prior Publication Data

US 2014/0261332 A1 Sep. 18, 2014

(51) Int. Cl.

| | |
|---|---|
| ***F02M 61/14*** | (2006.01) |
| *F02M 61/16* | (2006.01) |
| *F02M 69/46* | (2006.01) |
| *F02M 55/02* | (2006.01) |

(52) U.S. Cl.

CPC ..... *F02M 61/14* (2013.01); *F02M 55/025* (2013.01); *F02M 61/145* (2013.01); *F02M 61/168* (2013.01); *F02M 69/465* (2013.01); *F02M 2200/855* (2013.01); *F02M 2200/856* (2013.01); *F02M 2200/857* (2013.01); *F02M 2200/858* (2013.01)

(58) Field of Classification Search

CPC .. F02M 61/14; F02M 69/465; F02M 61/145; F02M 2200/858; F02M 61/168

USPC ..... 123/470

See application file for complete search history.

(56) References Cited

U.S. PATENT DOCUMENTS

2010/0300409 A1* 12/2010 Harvey ..... F02M 61/14 123/470

2010/0313851 A1* 12/2010 Di Domizio et al. ..... 123/470

FOREIGN PATENT DOCUMENTS

JP 2011-226425 11/2011

* cited by examiner

*Primary Examiner* — Lindsay Low

*Assistant Examiner* — Charles Brauch

(74) *Attorney, Agent, or Firm* — Harness, Dickey & Pierce, P.L.C.

(57) ABSTRACT

A mounting assembly for mounting a fuel injector to a fuel rail. The mounting assembly includes a mounting boss and a fuel cup. The mounting boss is configured to be mounted to the fuel rail and receive a bolt within the mounting boss to couple the fuel rail to a cylinder head. The fuel cup is coupled to the mounting boss and configured to receive the fuel injector therein, as well as be mounted to the fuel rail to direct fuel from the fuel rail to the fuel injector.

17 Claims, 2 Drawing Sheets

INTEGRATED SEALING AND POSITIONING STRUCTURE FOR FUEL RAIL

FIELD

The present disclosure relates to an integrated sealing and positioning device for a fuel rail.

BACKGROUND

This section provides background information related to the present disclosure, which is not necessarily prior art.

Fuel systems for combustion engines often include a fuel rail connected to a cylinder head with bolts. The bolts extend through mounting bosses affixed to the fuel rail to couple with the cylinder head. Also extending between the fuel rail and the cylinder head are a plurality of fuel injectors. The fuel injectors are received within fuel cups, which are coupled to the fuel rail. During operation of the engine, as fuel is delivered from the fuel rail to the engine through the fuel injectors, the injectors are subject to various pressures and vibrations. To enhance the efficiency of fuel delivery and prevent possible damage to the fuel injectors, it is desirable to align the fuel injectors along a longitudinal axis parallel to a longitudinal axis of the cylinder bolts and the mounting bosses through which the bolts extend. Such alignment is difficult to achieve and requires very precise arrangement of the fuel injectors and the mounting bosses during assembly. A device that facilitates parallel alignment of a fuel injector and both a mounting boss and cylinder head bolt would thus be desirable.

SUMMARY

This section provides a general summary of the disclosure, and is not a comprehensive disclosure of its full scope or all of its features.

The present teachings provide for a mounting assembly for mounting a fuel injector to a fuel rail. The mounting assembly includes a mounting boss and a fuel cup. The mounting boss is configured to be mounted to a fuel rail and receive a bolt within the mounting boss to couple the fuel rail to a cylinder head. The fuel cup is coupled to the mounting boss and configured to receive the fuel injector therein, as well as be mounted to the fuel rail to direct fuel from the fuel rail to the fuel injector.

The present teachings also provide for a mounting assembly for mounting a fuel injector to a fuel rail including a fuel cup, a mounting boss, and a coupling member. The fuel cup is configured to receive a fuel injector therein and be mounted to a fuel rail to direct fuel from the fuel rail to the fuel injector. The mounting boss is configured to be mounted to the fuel rail and receive a bolt within the mounting boss to couple the fuel rail to a cylinder head. The coupling member couples the fuel cup to the mounting boss to align the fuel cup and the mounting boss along a first axis of the fuel cup that extends parallel to a second axis of the mounting boss.

The present teachings still further provide for a mounting assembly for mounting a fuel injector to a fuel rail. The mounting assembly includes a fuel cup and a coupling member. The fuel cup is configured to be mounted to the fuel rail and receive a fuel inlet end of the fuel injector within the fuel cup, and align the fuel injector along a first longitudinal line. The coupling member extends from the fuel cup and defines an aperture of the coupling member. The coupling member is configured to extend to and couple with a mounting boss mounted to the fuel rail. The coupling member is also configured to align a bolt extending through the mounting boss and the aperture along a second longitudinal line that is parallel to the first longitudinal line Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
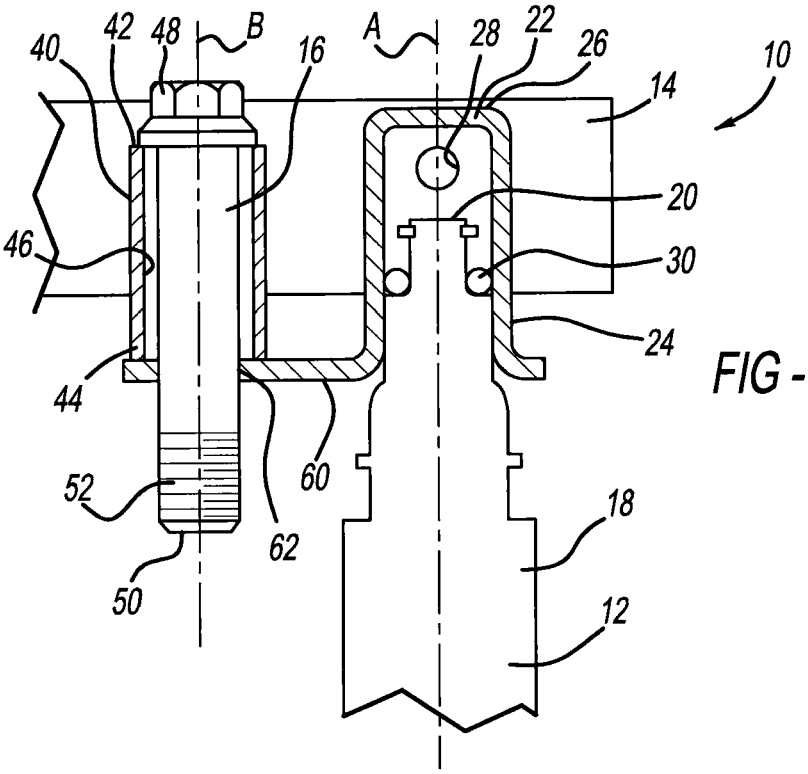
FIG. 1 is a cross-sectional view of a mounting assembly for a fuel injector according to the present teachings, the mounting assembly including a coupling member.

With initial reference to FIG. 1, a mounting assembly according to the present teachings is generally illustrated at reference numeral 10. The mounting assembly 10 is configured to mount a fuel injector 12 to a fuel rail 14. The fuel injector 12 is also mounted to a cylinder head (not shown). As described herein, the mounting assembly 10 is configured to mount the fuel injector 12 along a first longitudinal axis A. The first longitudinal axis A extends parallel to, or generally parallel to, a second longitudinal axis B along which a bolt 16 extends. The bolt 16 is configured to mount the fuel rail 14 to the cylinder head as further described herein.

The fuel injector 12 generally includes a body 18 and a fuel inlet end 20, which is mounted at the fuel rail 14 by fuel cup 22. The fuel cup 22 includes a cylindrical sidewall 24 and a base 26. The fuel cup 22 is mounted to the fuel rail 14 at a fuel rail opening 28 in any suitable manner. For example, the fuel cup 22 can be brazed onto the fuel rail 14. The fuel inlet end 20 of the fuel injector 12 is seated within the fuel cup 22, and a seal 30 of the fuel injector 12 provides a seal between the body 18 of the fuel injector 12 and an interior of the cylindrical sidewall 24 of the fuel cup 22, in order to prevent fuel from leaking out from within the fuel cup 22. The cylindrical sidewall 24 of the fuel cup 22 is sized to receive the body 18 of the fuel injector 12 therein such that the body 18 abuts or nearly abuts the cylindrical sidewall 24 and the fuel cup 22 aligns the fuel injector 12 along the first longitudinal axis A. The first longitudinal axis A extends generally through an axial center of the fuel cup 22 and the fuel injector 12.

Also mounted to the fuel rail 14 is a mounting boss 40. The mounting boss 40 is mounted to the fuel rail 14 proximate to the fuel cup 22, and can be mounted to the fuel rail 14 in any suitable manner, such as with any suitable device or method. For example, the mounting boss 40 can be mounted to the fuel rail 14 by brazing. The mounting boss 40 generally includes a first end 42 and a second end 44 that is opposite to the first end 42. The mounting boss 40 defines a mounting boss aperture 46, which extends between the first end 42 and the second end 44.

The bolt 16 generally includes a head 48 and a distal end 50 at an end of the bolt 16 opposite to the head 48. Proximate to the distal end 50, the bolt 16 includes a plurality of threads 52. The bolt 16 extends through the mounting boss aperture 46 and is positioned such that the head 48 is seated on the first end 42 of the mounting boss 40, and both the distal end 50 and threads 52 are arranged beyond the second end 44.

The mounting assembly 10 further includes a coupling member 60. The coupling member 60 defines a coupling aperture 62. The coupling member 60 extends from the fuel cup 22 to the second end 44 of the mounting boss 40 such that the coupling aperture 62 is aligned with the mounting boss aperture 46. The coupling member 60 can be coupled to the second end 44 of the mounting boss 40 in any suitable manner, such as by brazing. The coupling member 60 is coupled to the mounting boss 40 in any suitable manner to orient the mounting boss aperture 46 such that longitudinal axis B extending through the axial center of the mounting boss aperture 46 extends parallel to the longitudinal axis A. The coupling member 60 need not be rigidly coupled to the mounting boss 40, but can instead abut the second end 44 without being rigidly coupled thereto. As illustrated in FIG. 1, the coupling member 60 is integral with the fuel cup 22. In other words, the coupling member 60 and the fuel cup 22 are monolithic.

The coupling aperture 62 has an inner diameter that is smaller than an inner diameter of the mounting boss aperture 46. The coupling aperture 62 has a diameter that closely approximates an outer diameter of the bolt 16 to center the bolt 16 within the mounting boss aperture 46 spaced apart from inner sidewalls thereof and along the longitudinal axis B.

The mounting assembly 10 thus ensures that the longitudinal axis A of the fuel cup 22 is parallel to the longitudinal axis B of the mounting boss 40. This facilitates coupling of the fuel cup 22 and the mounting boss 40 to the fuel rail 14 during assembly by reducing the precision required to align the fuel cup 22 and the mounting boss 40 such that longitudinal axes A and B are parallel to one another by hand, or with a separate device. The mounting assembly 10 can thus reduce costs and allow for more accurate, parallel alignment of the fuel cup 22 with respect to the mounting boss 40. Because the fuel cup 22 and the mounting boss 40 will be aligned in parallel along longitudinal axes A and B respectively, the fuel injector 12 and the bolt 16 will also be aligned in parallel along longitudinal axes A and B respectively, which will potentially reduce stress on the fuel injector 12, caused by tilting and side-loading for example, during operation thereof as compared to instances where the fuel injector 12 may be aligned at an angle relative to the bolt 16. Therefore, potential performance degradation of the fuel injector 12 is made less likely.

Figure 2:
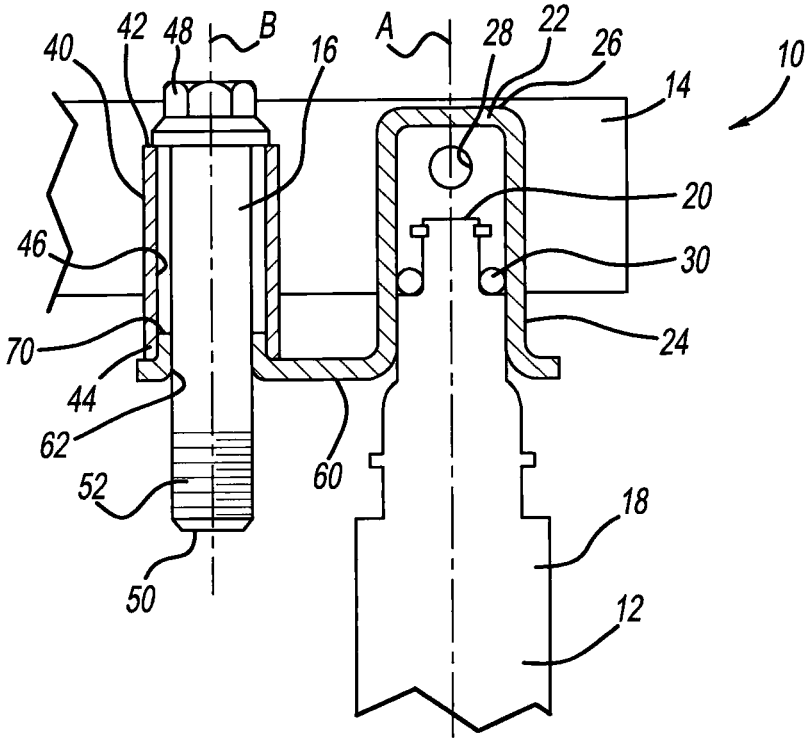
FIG. 2 is a cross-sectional view of the mounting assembly of FIG. 1, the coupling member configured differently as compared to FIG. 1.

With additional reference to FIG. 2, the coupling member 60 may include a flange 70, which surrounds the coupling aperture 62 and further defines the coupling aperture 62. The flange 70 increases the contact area between the coupling member 60 and the bolt 16 in order to ensure more precise alignment of the bolt 16 within the mounting boss aperture 46 along the longitudinal axis B. The flange 70 and the mounting boss 40 can be connected in any suitable manner, such as by brazing. Furthermore, the mounting boss 40 may be arranged within the mounting boss aperture 46 without being rigidly coupled thereto.

Figure 3:
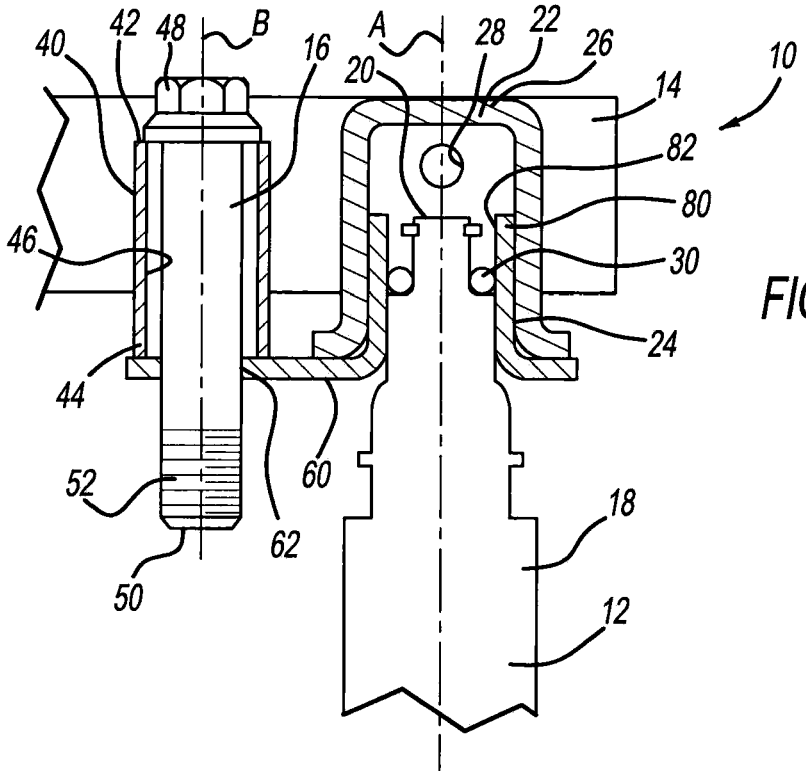
FIG. 3 is a cross-sectional view of the mounting assembly of FIG. 1, with the coupling member provided with another configuration.
Figure 4:
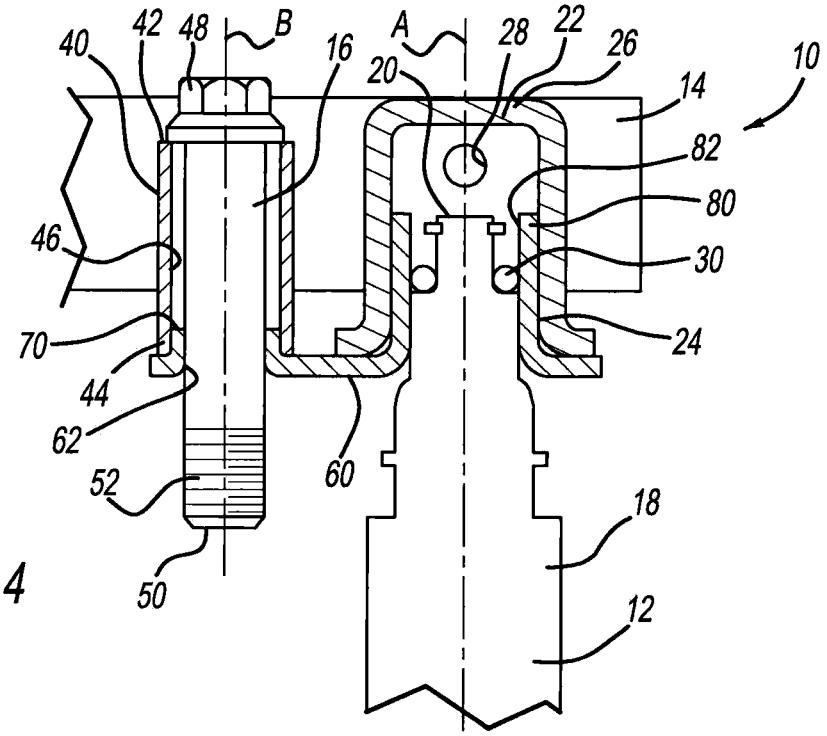
FIG. 4 is a cross-sectional view of the mounting assembly of FIG. 1 with the coupling member provided in still another configuration.

With additional reference to FIG. 3, the coupling member 60 need not be integral or monolithic with the fuel cup 22, but can instead be a modular part that can be coupled to the fuel cup 22. For example, the coupling member 60 can include a fuel cup flange 80 that extends within the fuel cup 22. The fuel cup flange 80 defines an aperture 82 through which the body 18 of the fuel injector 12 extends. The fuel cup flange 80 is sealed to the cylindrical sidewall 24 of the fuel cup 22 in any suitable manner, such as by brazing. The fuel cup flange 80 extends into the fuel cup 22 beyond the seal 30 to provide a fluid type sealing attachment between the coupling member 60 and the fuel cup 22. With reference to FIG. 4, the coupling member 60 can include the mounting base flange 70 when providing with the fuel cup flange 80.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A mounting assembly for mounting a fuel injector to a fuel rail comprising:

a mounting boss configured to be mounted to the fuel rail and receive a bolt within the mounting boss to couple the fuel rail to a cylinder head;

a fuel cup coupled to the mounting boss configured to receive the fuel injector therein and be mounted to the fuel rail to direct fuel from the fuel rail to the fuel injector; and a coupling member that couples the fuel cup to the mounting boss, the coupling member includes a fuel cup flange that extends into the fuel cup and is coupled to the fuel cup by brazing to couple the coupling member to the fuel cup;

wherein the coupling member includes a coupling member aperture surface defining a coupling aperture, the mounting boss defines a mounting boss aperture, the coupling aperture has an inner diameter that is less than an inner diameter of the mounting boss aperture, and the coupling member aperture surface faces a portion of the bolt that is devoid of threads.

2. The mounting assembly of claim 1, wherein the mounting boss is non-rigidly coupled to the fuel cup.

3. The mounting assembly of claim 1, wherein the fuel cup is coupled to the mounting boss such that the fuel cup and the mounting boss are aligned along parallel axes.

4. The mounting assembly of claim 1, wherein the coupling member defines an aperture aligned with an axial center of the mounting boss.

5. A mounting assembly for mounting a fuel injector to a fuel rail comprising:

a fuel cup configured to receive a fuel injector therein and be mounted to a fuel rail to direct fuel from the fuel rail to the fuel injector; and a mounting boss configured to be mounted to the fuel rail and receive a bolt within the mounting boss to couple the fuel rail to a cylinder head; and a coupling member coupling the fuel cup to the mounting boss to align the fuel cup and the mounting boss along a first axis of the fuel cup that extends parallel to a second axis of the mounting boss, the coupling member includes a fuel cup flange that extends into the fuel cup and is coupled to the fuel cup by brazing to couple the coupling member to the fuel cup;

wherein the coupling member includes a coupling member aperture surface defining a coupling aperture, the mounting boss defines a mounting boss aperture, the coupling aperture has an inner diameter that is less than an inner diameter of the mounting boss aperture, and the coupling member aperture surface faces a portion of the bolt that is devoid of threads.

6. The mounting assembly of claim 5, wherein the first axis extends through an axial center of the fuel cup and the second axis extends through an axial center of the mounting boss.

7. The mounting assembly of claim 5, wherein the coupling member includes a flange that extends into an aperture defined by the mounting boss thereby reducing the aperture's diameter at the flange.

8. The mounting assembly of claim 5, wherein the coupling member and the mounting boss are brazed together.

9. A mounting assembly for mounting a fuel injector to a fuel rail comprising:

a fuel cup configured to be mounted to the fuel rail and receive a fuel inlet end of the fuel injector within the fuel cup, and align the fuel injector along a first longitudinal line; and a coupling member extending from the fuel cup and defining an aperture of the coupling member, the coupling member configured to extend to and couple with a mounting boss mounted to the fuel rail, the coupling member configured to align a bolt extending through the mounting boss and the aperture along a second longitudinal line that is parallel to the first longitudinal line, the coupling member includes a fuel cup flange that extends into the fuel cup and is coupled to the fuel cup by brazing to couple the coupling member to the fuel cup;

wherein the coupling member includes a coupling member aperture surface defining a coupling aperture, the mounting boss defines a mounting boss aperture, the coupling aperture has an inner diameter that is less than an inner diameter of the mounting boss aperture, and the coupling member aperture surface faces a portion of the bolt that is devoid of threads.

10. The mounting assembly of claim 9, wherein the aperture of the coupling member is at least partially defined by the fuel cup flange.

11. The mounting assembly of claim 9, wherein the fuel cup flange at least partially defines the aperture configured to receive the fuel injector therein.

12. The mounting assembly of claim 11, wherein the fuel cup flange is between a seal of the fuel injector and the fuel cup, the fuel cup flange extends into the fuel cup toward a base of the fuel cup and beyond a portion of the seal closest to the base.

13. The mounting assembly of claim 1, wherein the fuel cup flange is between a seal of the fuel injector and the fuel cup when the fuel injector is mounted to the fuel rail, the fuel cup flange extends into the fuel cup toward a base of the fuel cup and beyond a portion of the seal closest to the base.

14. The mounting assembly of claim 5, wherein the fuel cup flange is between a seal of the fuel injector and the fuel cup when the fuel injector is mounted to the fuel rail, the fuel cup flange extends into the fuel cup toward a base of the fuel cup and beyond a portion of the seal closest to the base.

15. The mounting assembly of claim 1, wherein the fuel cup flange is monolithic with the coupling member.

16. The mounding assembly of claim 5, wherein the fuel cup flange is monolithic with the coupling member.

17. The mounting assembly of claim 9, wherein the fuel cup flange is monolithic with the coupling member.

* * * * *